United States Patent [19]

Kugel

[11] 4,225,317

[45] Sep. 30, 1980

[54] ALKYL PHENOXY POLY(ETHYLENEOXY)ETHANOL IN FUEL OIL TO PREVENT COAL PARTICLES FROM FREEZING TOGETHER

[75] Inventor: Roger W. Kugel, Warrenville, Ill.

[73] Assignee: Nalco Chemical Company, Oak Brook, Ill.

[21] Appl. No.: 18,541

[22] Filed: Mar. 8, 1979

[51] Int. Cl.[3] ..... C10L 9/00

[52] U.S. Cl. ..... 44/6; 252/70

[58] Field of Search ..... 44/6, 1 R; 252/70; 427/220

[56] References Cited

U.S. PATENT DOCUMENTS

| | | | |
|---|---|---|---|
| 2,116,682 | 5/1938 | Kleinicke et al. | 44/6 |
| 2,373,727 | 4/1945 | West et al. | 106/13 |
| 2,436,146 | 2/1943 | Kleinicke | 252/38 |
| 2,716,068 | 8/1955 | Fain et al. | 106/13 |
| 3,298,804 | 1/1967 | Schoch | 44/6 |
| 3,624,243 | 11/1971 | Scott, Jr. et al. | 252/70 |
| 3,794,472 | 2/1974 | Maculuso et al. | 44/6 |
| 4,117,214 | 9/1978 | Parks | 427/220 |

*Primary Examiner*—Carl F. Dees

*Attorney, Agent, or Firm*—John G. Premo; Robert A. Miller

[57] ABSTRACT

A method for treating particulate solids having surface moisture to reduce the cohesive strength of masses of such solids when frozen, said particulate solids being neither water soluble nor water swellable, said method consisting of spraying such solids with an effective amount of a hydrocarbon liquid solution of a nonionic surfactant having an HLB between 9.5 and 11.0.

3 Claims, No Drawings

ALKYL PHENOXY POLY(ETHYLENEOXY)ETHANOL IN FUEL OIL TO PREVENT COAL PARTICLES FROM FREEZING TOGETHER

INTRODUCTION

When the surface moisture on particulate solids freezes, the ice acts as a powerful adhesive holding the particles together in a mass. The adhesivity is influenced by both the particle size of the solids and the moisture content as shown later. For example, coal with as little as 4 percent moisture will, when frozen, cohere so strongly as to require special handling to break up the frozen mass. It thus becomes difficult to unload or dump railway cars, trucks and other conveyances used to transport coal, mineral ores and other finely divided solids. It also makes difficult the movement of coal out of outdoor coal storage piles in a condition for fuel or other use. Unloading frozen coal from railroad cars is time consuming, can result in blocked dump chutes and can often leave as much as 30 to 60 tons of coal in the car. Various techniques such as vibration, steam lances, fires under the cars, infrared heating in warming sheds and even dynamiting have been tried to unload frozen cars. The safety problems inherent in some of these techniques are obvious. Others are ineffective or totally impractical from an economic standpoint, particularly where conditions are so severe as to cause entire carloads of coal to freeze solid (as distinguished from merely perimeter freezing). All of these factors point to the definite need of developing an economic method of treating coal, ores and other divided solids to overcome the problems of transport of those solids.

Various approaches have been used with limited degrees of success. Sodium chloride and calcium chloride salts have been added to moist coal as it is being loaded with some degree of success toward reducing the freezing problem. However, such salts contribute to the corrosion of all equipment with which the solids come in contact and are detrimental to the coking process when used with coking coal. Oil has been used to freeze-proof coal with questionable effectiveness. Oil soluble surfactants have been added to the oil but with questionable results. Ethylene glycol has been employed, but although successful, the cost of treatment has been very high.

The Prior Art

Parks, U.S. Pat. No. 4,117,214. The teachings of this patent are summarized in the Abstract, a portion of which is presented below:

"The strength of ice is reduced by dissolving in water prior to freezing a composition of (A) a water-soluble polyhydroxy compound of monoalkylether thereof and (B) a water-soluble organic nonvolatile compound having a hydrophilic group such as amine, carboxyl or carboxylate groups in an amount to provide an effective amount, e.g., on the order of about 0.25–5 weight percent, of (A) plus (B) based on the weight of water."

Schloch, U.S. Pat. No. 3,298,804 is directed to the prevention of freezing together of coal particles. That is accomplished with a composition of a hydrocarbon and a given class of surface-active compounds.

Kleinicke et al., U.S. Pat. No. 2,116,682 teaches treating coal with water containing a gel forming colloid and various inorganic salts. At page 3, right column, lines 5–23, the patent teaches some ice may form at low temperatures, but teaches away from suggesting the ice is modified by suggesting the solute becomes more concentrated in the remaining solution which is unfrozen. Kleinicke, U.S. Pat. No. 2,436,146, teaches addition of a protective agent such as polyhydric alcohol to such a composition to prevent the salt from degrading the colloid.

Mori, U.S. Pat. No. 2,222,370, teaches a dust settling composition for coal mines which is an emulsion which may contain small quantities of ethylene glycol and oleic acid to give the emulsion greater permanence or stability, but no mention is made of cold weather applications.

Macaluso et al., U.S. Pat. No. 3,794,472, treat coal with an emulsion to prevent freezing of the coal.

Other art relating principally to deicing compositions or freeze depressants, particularly those suited for aircraft deicing applications, was cited in the parent application, including: Korman, U.S. Pat. No. 2,101,472, which teaches a gel containing gelatine to which is added as an antifreeze substance, glycerol and/or a glycol; West et al., U.S. Pat. No. 2,373,727, which teaches a composition such as in Korman, but also including a hydrocarbon to provide an emulsion; Fain et al., U.S. Pat. No. 2,716,068, which teaches a composition of a glycol, at least one of potassium thiocyanate, potassium acetate, urea, or ceratin inorganic salts, and optionally sodium nitrite; and Dawtrey et al., U.S. Pat. No. 3,350,314, which teaches a foamable composition of water, an alkylene polyol, and a long chain aliphatic tertiary amine.

Ordelt et al., U.S. Pat. No. 3,362,910, teaches an automotive antifreeze composition.

Scott, Jr., et al., U.S. Pat. Nos. 3,624,243 and 3,630,913, each relate to chemical deicers containing corrosion inhibitors making them specially suited for use on airport runways.

Finally, Shapiro, U.S. Pat. No. 2,454,886, relates to the prevention of mist and frost on glass and similar sheet material.

THE INVENTION

A method for treating particulate solids having surface moisture to reduce the cohesive strength of masses of such solids when frozen, said particulate solids being neither water soluble nor water swellable, said method consisting of spraying such solids with an effective amount of a hydrocarbon liquid solution of a nonionic surfactant having and HLB between 9.5 and 11.0. The amount of nonionic surfactant in the hydrocarbon liquid typically is between 0.5–20% by weight.

While the invention has utility in the treatment of a variety of particulate solids having surface moisture to prevent sticking due to freezing, its greatest usefulness is found in the treatment of coal particles during cold winter weather.

The Nonionic Surfactant

As indicated, the nonionic surfactant should have an HLB between 9.5 and 11.0. Preferably, it has an HLB between the range of 10.5 and 10.8 with 10.6 being the most preferred. HLB, of course, refers to the so-called Atlas HLB System which is described in the publication entitled, *The Atlas HLB System,* 4th Printing, Published by Atlas Chemical Industries, 1963.

The preferred wetting agents of the invention are within the middle of the HLB scale and, therefore, they tend to have both hydrophilic and hydrophobic properties. The surfactants may be further defined in that they are capable of forming either oil-in-water or water-in-oil emulsions depending upon the particular ratio of water to oil being emulsified. Thus, if there is a preponderance of water, an oil-in-water emulsion would be formed; whereas, if oil is in the preponderance, then a water-in-oil emulsion would be formed. Those used in this invention should be primarily oil-soluble and contain not more than 10 moles of ethylene oxide.

A preferred surfactant which acts as an emulsifier is dinonyl phenol which has been reacted with 8.8 moles of ethylene oxide.

The Hydrocarbon Liquid

The hydrocarbon liquid acts as a carrier for the nonionic surfactant which allows a liquid formulation to be produced. It further acts as an emulsification agent for the water coated around the particles to be treated. While any normally liquid hydrocarbon may be employed, it is preferred to use a predominantly aliphatic hydrocarbon oil such as, for instance, No. 2 fuel oil. Other organic liquids that can be used are naphthas, kerosenes, pure hydrocarbon liquids such as hexane and the like.

In preparing the compositions of the invention, it is desirable to prepare a concentrate, e.g. the fuel oil should contain at least 5% or more by weight of the nonionic surfactant although the invention is not limited to such concentrates. In certain instances, it is beneficial if from 0.5–10% by weight water is added to the oil which acts as a cosolvent for the nonionic surfactant, thus allowing more of the surfactant to be dissolved in the oil, thus providing more convenient concentrates. A typical composition of the invention, Composition A, is 15% dinonyl phenol reacted with 8.8 moles of ethylene oxide; 1% water; 84% No. 2 fuel oil. These percentages are by weight.

Evaluation of the Invention

In order to evaluate the invention, the following test method was used:

Samples of coal are passed through a ½" mesh screen and freeze release testing is carried out on the −½" fraction. Occasionally, narrower ranges in coal size consist are used for more size uniformity and reproducibility. In any case, the topsize of the coal samples used in freeze release testing is always ≦½". If necessary, moisture may be added to the coal to increase its propensity to freeze. This is typically accomplished using a spray nozzle-tumbler arrangement so that water is applied in a fine mist as the coal is tumbling.

The larger coal sample is riffled into a number of 1000 gm samples for treatment. These samples are placed into 1 gallon plastic jars and covered to prevent moisture loss. Liquid additives are sprayed on the samples using an air-atomizing nebulizer while the coal is tumbling in the plastic jars. The tumbling is accomplished by rolling the jars on a laboratory scale jar roller. (Solid additives may be sprinkled onto the coal and the samples tumbled in a similar manner.)

The treated coal is transferred to plastic cylinders (2⅝" ID×3¾" L), shaken with a mechanical vibrator to ensure packing uniformity, and placed in a freezer for a given period of time. Typically the samples are stored at −15° F. overnight.

After the freezing period, the coal samples are removed from the plastic cylinders and the unconfined compression strengths measured using a Soiltest Model U164 Compression Strength tester. The more successful treatments result in frozen coal having smaller unconfined compression strengths.

Composition A was tested at 1 qt. per ton and at 2 qt. per ton of coal. At the first dosage, the compression strength was reduced by 57%. At the higher dosage, the compression strength was reduced 73%.

The amount of the compositions used to treat coal and other particulate matter to prevent freezing will vary depending upon the concentration of the nonionic surfactant in the oil, the size of the particles in the solids, the nature of the solids, and the amount of moisture present on these solids. With all of these variables, it is obvious that routine experiments will have to be employed to determine the optimum dosage in each particular case.

Having thus described my invention. it is claimed:

1. A method for treating coal particles having surface moisture to reduce the cohesive strength of such coal particles when frozen which comprises spraying the coal particles prior of freezing with an effective amount of a hydrocarbon liquid solution of a nonionic surfactant having a HLB between 9.5 and 11.0.

2. The method of claim 1 where the hydrocarbon oil surfactant solution contains between 0.5–10% by weight of water as a cosolvent.

3. The method of claim 1 where the nonionic surfactant is dinonyl phenol reacted with 8.8 moles of ethylene oxide.

* * * * *